United States Patent [19]

Saito et al.

[11] 4,338,277

[45] Jul. 6, 1982

[54] PROCESS FOR PRODUCING HIGH KNOT STRENGTH POLYAMIDE MONOFILAMENTS

[75] Inventors: Isoo Saito, Okazaki; Kotaro Fujioka, Nagoya, both of Japan

[73] Assignee: Toray Industries, Inc., Tokyo, Japan

[21] Appl. No.: 179,703

[22] Filed: Aug. 20, 1980

[30] Foreign Application Priority Data

Aug. 20, 1979 [JP] Japan ..... 54-104963

[51] Int. Cl.[3] ..... B29C 17/02

[52] U.S. Cl. ..... 264/235.6; 264/289.3; 264/289.6; 264/290.5; 264/DIG. 28

[58] Field of Search ..... 264/289.6, 290.5, 289.3, 264/235.6, 235, DIG. 28

[56] References Cited

U.S. PATENT DOCUMENTS

| | | | |
|---|---|---|---|
| 3,090,997 | 5/1963 | Au | 264/290.5 |
| 3,156,750 | 11/1964 | Cuculo | 264/289.6 |
| 3,577,500 | 5/1971 | Kohler et al. | 264/290.5 |
| 3,595,952 | 7/1971 | Boyer et al. | 264/235 |
| 3,650,884 | 3/1972 | Hansen | 428/395 |
| 3,742,104 | 6/1973 | Jamison | 264/289.6 |
| 4,009,511 | 3/1977 | Gauntt | 264/290.5 |

FOREIGN PATENT DOCUMENTS

| | | | |
|---|---|---|---|
| 45-26566 | 9/1970 | Japan | 264/289.6 |
| 49-1817 | 1/1974 | Japan | 264/290.5 |

*Primary Examiner*—James B. Lowe

*Attorney, Agent, or Firm*—Austin R. Miller

[57] ABSTRACT

Process for producing polyamide monofilament including partially orienting polyamide monofilament, steaming the partially oriented monofilament, heating and relaxing under low tension for disturbing the molecular orientation of the skin layer of said monofilament and drawing the relaxed monofilament to raise the molecular orientation of its core.

Monofilaments of this invention are high in knot strength and are two-layer structures comprising a core and a skin layer. The monofilaments have an average index of birefringence of at least about $50\times10^{-3}$ and a degree of molecular orientation in the amorphous region of said skin layer of not more than about 0.5.

17 Claims, No Drawings

PROCESS FOR PRODUCING HIGH KNOT STRENGTH POLYAMIDE MONOFILAMENTS

BACKGROUND OF THE INVENTION

The present invention relates to a process for producing high knot strength polyamide monofilaments.

Polyamide monofilaments (hereinafter referred to briefly as monofilaments) are preferably used for fishing lines and fishing nets due to their toughness, transparency and flexibility. In these uses the monofilaments are often knotted. Because the monofilaments tend to break at these knots, improvement in knot strength is required.

If the knot strength of the monofilament could be improved enough, the monofilament could be used in a significantly finer denier. This would also significantly improve the transparency and flexibility of the monofilament and products such as fishing line and fishing net could be produced which would have excellent performance.

For this purpose, a special structure has heretofore been proposed (U.S. Pat. No. 3,595,952). Drawn monofilament is heat-treated with saturated or wet steam, and for improving knot strength attention is paid to the condition of the skin layer. However, this process has still room for further improvement for stably obtaining monofilament having a knot strength of not less than 5 g./denier, preferably not less than 6 g./denier, in a denier up to about 3,000. It does not respond to the requirements of those skilled in the art as a process for drastically improving knot strength.

The process of U.S. Pat. No. 3,595,952 modifies to some extent the elastic properties of the skin layer of the monofilament, but does not cause sufficient molecular orientation in the inner layer of monofilament to provide sufficient endurance against load.

We have observed that, when knots were made of monofilament and the knotted monofilament was pulled, portions of the skin layer of the monofilament were subjected to extension and other portions to compression. We have found that a monofilament having high knot strength had very special properties. It must have strengths enabling the skin layer of the monofilament to cope with deformation due to extension and contraction as well as compression. We refer to this property hereinafter as the elasticity of the monofilament. This elasticity should be great.

We have also found that the monofilament should be endowed with properties enabling the inner layer or core of the monofilament to withstand stresses in a direction along the length of the monofilament, such stresses being applied to the monofilament per se. These inner layer properties are hereinafter referred to as endurance or load strength, which should be high.

We have accordingly discovered that a significant increase of monofilament knot strength may be achieved by causing the skin layer of the monofilament to form a specified molecular structure for developing the aforesaid elastic property and by also causing the inner layer of the monofilament to acquire a high molecular orientation for increasing endurance to load, and that this can be achieved by causing the monofilament to form different phases of heterogeneous sectional structures.

OBJECTS OF THE INVENTION

An important object of the present invention is to provide a process for producing monofilaments having high knot strength.

Another object of the present invention is to provide a process for producing monofilaments having a skin layer having excellent elastic properties and having a core which has excellent load endurance.

Other objects and advantages of this invention will appear in further detail hereinafter.

BRIEF SUMMARY OF THE INVENTION

The aforesaid objects of the present invention are achieved by treating monofilaments in accordance with novel steps which include:

(A) drawing melt spun undrawn monofilament ($M_1$) at a draw ratio of about 3–5.5 to produce a partially oriented monofilament ($M_2$) having a diameter of about 0.05–2 mm;

(B) passing the monofilament ($M_2$) through a pressure chamber filled with saturated steam having a pressure not less than about 1 kg/cm$^2$.G for about 0.05–5 second, relaxing and partially oriented monofilament ($M_2$) to a length of about 0.7–1.0 times its length before relaxation to produce a relaxed monofilament ($M_3$); and (C) passing the monofilament ($M_3$) through a heating zone containing either an inert gas at about 200°–800° C. and/or a liquid at about 150°–265° C., and drawing the relaxed monofilament ($M_3$) at a ratio of about 1.2–2.5 to produce a drawn monofilament ($M_4$).

It has surprisingly been discovered that, by the aforesaid process, polyamide monofilaments are obtained which comprise sectional structures comprising an inner portion or core and an outer portion or skin layer, the monofilaments having an average index of birefringence of at least about $50\times10^{-3}$, and wherein the degree of molecular orientation in the amorphous region of the skin layer is not more than about 0.5.

Preferably the following step (D) is performed after step (C):

(D) passing the monofilament ($M_4$) through a hot water zone containing hot water at about 50°–97° C. for about 0.05–20 seconds and relaxing said monofilament ($M_4$) to about 0.9–1.0 times its pre-relaxed length to produce a heatset monofilament ($M_5$).

DETAILED DESCRIPTION OF THE INVENTION

The process of the present invention basically comprises at least three steps including drawing undrawn monofilament ($M_1$) to thereby make it partially oriented monofilament ($M_2$), heating the monofilament ($M_2$) in steam and relaxing its length to some extent to produce a relaxed monofilament ($M_3$), and imparting second-stage drawing to the monofilament ($M_3$) to produce a completely drawn monofilament ($M_4$). Further, as occasion demands, a fourth step may be added which comprises passing the monofilament ($M_4$) through a hot water zone, thereby relaxing and heatsetting the monofilament to about 0.9–1.0 times its length.

The steps of this invention will now be discussed in detail, one by one. The designation of steps by number is not intended to mean that these are the only steps to be practiced since many other procedures may be used before, after, between, or during the practice of the numbered steps explained in detail hereinafter.

First Step:

This step comprises drawing undrawn polyamide monofilament ($M_1$) melt spun through an inlet (a spinneret) to about 3–5.5 times its length, to provide a partially oriented monofilament ($M_2$) having a diameter of about 0.05–2 mm.

The polyamide is melt spun using any of a variety of known processes, is passed through a short cooling zone and thereafter the spun monofilament is quenched by a refrigerant of water, trichlorethylene or n-hexane to produce an undrawn monofilament ($M_1$).

Any of the known polyamides may be used in the practice of the present invention. These include, but are not limited to homopolymers such as polyhexamethylene adipamide (nylon 66), polyhexamethylene sebacamide (nylon 610), polycapramide (nylon 6), polydodecanamide (nylon 12) and polyhexamethylene isophthalamide (nylon 6I) and the like. Also included are copolymers thereof and blended polymers thereof. However, nylon 6 and copolymers thereof are considered to be optimum polyamides for use as fishing nets and fishing lines for which monofilaments of the present invention are typically used. Copolymers, of which the repeating units are at least about 85% $[(CH_2)_5NHCO]$-based on the entire weight, may be used. A blended polymer which is a blend of nylon 6 and another polyamide (nylon) contains at least about 85% of nylon 6 based upon the total weight.

Various additives may be used in producing the monofilament, including, for example, plasticizers, crystallization inhibitors, lubricants, pigments, dyestuffs, light stabilizers, ultraviolet absorbers and antioxidants. These may be added to polyamide at any suitable stage.

In accordance with this invention, the monofilament ($M_1$) is forwarded to a stretching machine (draw frame) and drawn to about 3–5.5 times its initial length. Drawing is, of course, known per se. As one example, the monofilament may be drawn between two spaced-apart pairs of rollers having different surface speeds. The ratio of surface speed values (or the ratio of final length to initial length of monofilament) is referred to as the "draw ratio" herein. Drawing is carried out in the presence of a gas such as air, steam, or any compatible inert gas at about 100°–400° C., or in a liquid such as, for example, glycerin, ethylene glycol, polyethylene glycol, polyorganosiloxane oil, mineral oil or a vegetable oil such as rapeseed oil, at a temperature of about 50°–200° C.

When the monofilament is drawn at a ratio outside of the aforesaid range and is subjected to the steps subsequent to said first step, it does not become a monofilament having the properties achieved by the present invention.

Namely, when monofilament is drawn at a ratio of less than 3, then in later processing at the time of later drawing in a high-temperature atmosphere, such later drawing must be carried out at a draw ratio higher than the desired ratio. Because of that, the elastic structure formed on the skin layer of the monofilament is caused to break. On the contrary, when monofilament is drawn at a ratio in excess of 5.5, it is difficult sufficiently to form a structure having the desired elastic properties on the skin layer of the monofilament.

The denier of the partially oriented monofilament ($M_2$) is necessarily limited. Namely, in the second step of relaxed heat-treatment—so-called because monofilament ($M_2$) is heat-treated under low tension—the specified structure is formed on the skin layer of the monofilament. Accordingly, because the monofilament is treated under the specified conditions, when the process of the present invention is applied to extremely fine monofilament, the conditions become too severe. On the contrary, extremely heavy monofilament does not sufficiently develop the effect of the present invention. The diameter of the monofilament ($M_2$) used in the present invention is about 0.05–2 mm, preferably about 0.08–1.2 mm based on the monofilament introduced into the second step.

Second Step:

This is the step of subjecting the aforesaid partially oriented monofilament ($M_2$) to relaxed heat-treatment or heat relaxation. The step is carried out while running the partially oriented monofilament ($M_2$) through a pressure chamber to which is supplied, for example, saturated steam having a pressure of at least about 1 $kg/cm^2 \cdot G$. The pressure chamber has an entrance through which the monofilament ($M_2$) enters and also has an exit for the monofilament ($M_2$), both sealed with sealing structures comprising a labyrinth, a slit or two pairs of rollers to prevent leakage of steam as much as possible and to permit inside of the pressure chamber to maintain a desired steam pressure. Inside the pressure chamber, the monofilament usually runs linearly and is controlled by the two-roll systems provided at the entrance and exit of the pressure chamber.

The filament running speed varies depending on the length and steam pressure of the pressure chamber. However, it is established according to the time required for the monofilament to pass through the pressure chamber, namely, the monofilament residence time, which is preferably about 0.05–5 seconds, more preferably about 0.1–2 seconds. When the residence time is shorter than about 0.05 second, the skin layer of the monofilament does not form the desired structure. When the residence time is greater than five seconds, the inner layer of the monofilament does not achieve high orientation even after being subjected to subsequent drawing in a high-temperature atmosphere.

The wet heat-treatment which constitutes the second step of the process is carried out in a relaxed state, control of which is carried out by the surface speeds of the aforesaid two-roll systems. The ratio of surface speed of the roll system on the exit side to the surface speed of the roll system on the entrance side, namely, the draw ratio, is within the range of about 0.70–1.0, preferably about 0.75–0.95.

When the wet heat-treatment of the present invention is carried out under tension at a draw ratio in excess of about 1, it becomes difficult effectively to form the structure having the desired skin layer elastic properties. When it is attempted to develop an effect the same as that of the treatment in a relaxed state, it becomes necessary to raise the pressure of the steam treatment or lengthen the treating time. However, when such severe conditions of wet heat-treatment are adopted, the monofilament becomes whitened or devitrified, or the surface of the monofilament partly melts, and a transparent monofilament having high knot strength cannot be obtained.

Again, the wet heat-treatment is carried out after the monofilament is introduced into the pressure chamber having the sealing structures; the procedures for introducing the monofilament through the pressure chamber and its sealing structures are relatively troublesome. Similar problems apply if the monofilament breaks during wet heat-treatment. Accordingly, it is necessary reliably to prevent the monofilament from being broken during wet heat-treatment. In this respect, the process of the present invention is very advantageous because it passes the monofilament ($M_2$) in a relaxed state through the pressure chamber.

Next, it is preferable to employ nip rolls subsequent to wet heat-treatment so that the step of wet heat-treatment will not be affected, should the monofilament ($M_2$) be broken in the third step.

In general, when monofilament is passed to wet heat-treatment at a high temperature, the skin layer of the monofilament is plasticized, coming into contact under tension with the sealing structure and with the guides inside the pressure chamber, with the result that the surface of the monofilament is prone to injury. By way of contrast, this does not tend to occur in the practice of the present invention, because the monofilament ($M_2$) passes through the pressure chamber in a relaxed state.

In the case of a monofilament having high knot strength, it is preferred to form an elastic structure only on the skin layer and of the necessary thickness. The desired thickness of the skin layer varies depending on the denier of the monofilament. However, in the practice of the present invention, the conditions of the processing steps should be so established as to make the ratio of the skin layer thickness to the total cross-sectional dimension of the monofilament about 1/50–1/250.

The monofilament according to this invention tends to have a skin layer having good elastic properties, which skin layer is distinct from the inner layer. It endures extension sufficiently for good service when knotted. Further, it withstands compression on the surface of the knotted portion when knots are made of the monofilament and the knotted monofilament is extended.

However, by wet heat-treatment in a relaxed state, the molecular orientation of the inner layer is reduced somewhat. Also, its physical properties, especially tensile strength, are lowered. Therefore, it is necessary to increase molecular orientation of the nylon more than that which was achieved prior to the wet heat-relaxation. In addition, the degree of molecular orientation should be increased without breaking the structure having elastic porperties expressly formed on the skin layer of the monofilament.

Therefore, in the practice of the present invention, second-stage drawing is further carried out by subjecting the monofilament to high-temperature atmosphere following said wet heat-relaxation. This high-temperature treatment step has the effect of heat drawing and, at the same time, of heatsetting. The high-temperature atmosphere referred to herein may be an inert gas (especially air) at about 200°–800° C., preferably about 250°–600° C. and/or an inert liquid at about 150°–265° C., preferably about 160°–240° C. The monofilament is passed through the hot atmosphere for a total of about 0.05–5 seconds, preferably about 0.1–2 seconds. During this period it is drawn at a ratio of about 1.1–2.5, preferably about 1.15–2.0.

Turning now to the apparatus for drawing and heatsetting in an inert gas medium, an air oven is ordinarily used. For blowing heated air and efficiently heating, a long-range infrared radiator may be utilized. The nature of the heating liquid may be, if desired, the same as in the first-stage drawing step: glycerin, ethylene glycol, polyethylene glycol, polyorganosiloxane oil, mineral oil, or vegetable oil, or mixtures may be used.

Control of draw ratio may be carried out by two-roll systems disposed in front and at the rear of the heating furnace.

When the foregoing drawing conditions are adopted, it becomes possible to draw the monofilament in a stable manner at a hitherto unattainably high draw ratio, because a highly oriented outer layer is converted to a structure having good elastic properties as a result of the treatment of the skin layer.

The monofilament according to the present invention may be completed by practicing the foregoing first, second and third steps after it is spun and cooled. However, it is preferable to add a further step to the third step. This step, referred to herein as the fourth step, comprising heat-treating the monofilament ($M_4$) in hot water to remove the strain which to some extent remains in the monofilament. Treating conditions are adopted which do not impair the characteristics of the drawn, heatset monofilament ($M_4$). Preferably, the monofilament ($M_4$) is passed through a hot water bath at about 50°–97° C. for about 0.05–20 seconds. During this period, the monofilament ($M_4$) is passed through at a draw ratio of about 0.9–1.0. Accordingly, the monofilament ($M_4$) is obtained in a somewhat relaxed state. Control of the draw ratio is carried out by two-roll systems disposed in front of and at the rear of the hot water bath.

The usual finishing oil is desirably applied to the monofilament for improving the net markability, flexibility, and friction properties of the monofilament prior to wind-up.

Although each of the three or four steps of the method may be operated under independently selected conditions within the ranges specified, and this does produce a desirable monofilament, it is preferred to operate the process in such a manner that the conditions for each step are selected in cooperation with the conditions selected for the other steps. As criteria of such operations, such conditions should be selected as to make the degree of orientation $\overline{F}$ of the amorphous molecules of the skin layer of the final monofilament less than about 0.5 and preferably less than about 0.4. The average index of birefringence should be at least about $50\times10^{-3}$, preferably at least about $52\times10^{-3}$.

Said index of birefrigence means the average for the skin layer and the inner layer of the monofilament. It is measured in accordance with the conventional compensator method. The amorphous molecular orientation degree $\overline{F}$ is a value obtained by immersing monofilament as a sample in a 0.2% aqueous solution of a fluorescent agent:

("Whitex RP" (R— 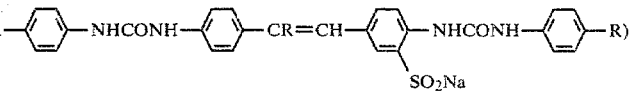 —R)

manufactured by Sumitomo Chemical Co., Ltd. of Japan) for two hours, thereafter washing the sample with water and air drying the sample, and measuring the $I_{0°}$ and $I_{90°}$ values of the resulting sample by use of an FOM-1 type fluorophotometer manufactured by Nippon Bunko Co., Ltd. of Japan. The value is calculated from the following equation:

$$\overline{F} = 1 - \frac{I_{90°}}{I_{0°}}$$

wherein, $I_{0°}$ = Relative fluorescence intensity in the direction of fiber axis, and $I_{90°}$ = Relative fluorescent intensity in a direction perpendicular to the direction of the fiber axis.

The thickness of the skin layer into which the fluorescent agent penetrates and where the degree of orientation of amorphous molecules is measured varies depending on the conditions of production of the monofilament; however, this thickness is ordinarily about 5μ. The thickness of the skin layer wherein a low degree of orientation of amorphous molecules is achieved may be known by determining degrees of orientation of amorphous molecules of the respective samples obtained by etching the top surface of the skin layer from the inner layer with a sulfuric acid/methanol mixed solution.

The wet knot strength is measured by the method described in JIS L 1034-78 on the basis of an initial load which is assumed to be ⅓ g./denier.

This method includes the following steps: The sample is knotted after the initial load is imparted and is immersed in water at room temperature. When the sample has absorbed a sufficient amount of water, the upper and lower ends of the filament are held by the two tester clamps so that the knot is between them.

The distance between the upper and lower clamps is 25 cm or 30 cm. Two clamps are pulled apart at a rate of 20–30 cm/min until the filament breaks. The load and the elongation [kgf{N} and %] at the breaking point are measured. Not less than 10 measurements are taken. The mean value obtained by the measurements is a dry tensile strength or elongation (of not more than 3 significant figures).

The resulting monofilament has high tensile strength and high wet knot strength and excellent uniformity. Because this monofilament has been highly oriented, its tensile modulus in the direction of the fiber axis is high, while on the other hand, the skin layer has an elastic structure. Therefore, the monofilament is flexible when bent and is very easy to handle in a net-making production line. Further, it is practical and advantageous in the ultimate operation of the net.

Further, this monofilament has excellent transparency just as in the case of monofilament produced by conventional methods.

Such monofilament is useful for use in fishing nets and fishing lines. Especially when it is made into a fishing net, a flexible high-strength fishing net is obtained, which is preferred and used in the field of gill nets, etc.

The following examples are intended to be illustrative of specific forms of the invention but are not intended to limit its scope, which is defined in the appended claims.

EXAMPLE 1

With nylon 6 chips having a sulfuric acid relative viscosity of 3.4 (according to JIS K 6810-1970, etc.) was mixed 0.2% by weight of N,N'-bis-stearyl-adipamide and the resulting mixture was melt spun using an extruder-type spinning machine. The molten polymer temperature was 273° C. The distance between the inlet (spinneret) and the liquid surface was 5 cm and chilled water at 5° C. was used for cooling the extruded polymer quickly. The resulting monofilament was continuously drawn at a ratio of 4.1 in hot water at 90° C. (first step). Thereafter, it was passed through a steam-treating cylinder having an effective treating length of 1 m equipped with labyrinth sealing structures in front and at the rear of the cylinder in the presence of saturated steam having a pressure of 3.0 kg/cm$^2$·G (second step). The ratio of surface speeds of the rolls at the entrance and at the exit of the steam-treating cylinder (draw ratio) was 0.83 and wet heat-treatment was carried out in a relaxed state. Subsequently, water adhered to the surface of the monofilament was removed. Thereafter the monofilament was passed through a heating furance (length, 3 m) having an atmosphere temperature of 400° C. while being drawn at a ratio of 1.59 (third step). Thereafter, finishing oil was fed by conventional means and the monofilament was wound up. The final winding speed was 150 m/min. and the denier of the monofilament was 1910.

The resulting monofilament had a dry tensile strength of 7.5 g./denier, a tensile elongation of 30.2%, a wet knot strength of 6.5 g./denier, a wet knot elongation of 35.4%, and a variation ratio of wet knot strength ($\sigma/\overline{X}_N$x 100%, n=20) of 3.5%. A monofilament having highly uniform knot strength and transparency was obtained. The index of birefringence and the degree of orientation of amorphous molecules $\overline{F}$ of the monofilament were $54\times10^{-3}$ and 0.22, respectively.

COMPARATIVE EXAMPLES 1–3

The monofilament from first-stage drawing as in Example 1 was not passed through the steam-treating cylinder as in Example 1, but water adhered to the surface of the monofilament was removed. Three runs were conducted. Immediately thereafter the monofilaments were so drawn as to make the synthetic draw ratios 5.2, 5.4, and 5.6, respectively in all three runs, all in a heating furnace at 400° C. Finishing oil was similarly fed and the monofilaments were wound up at a speed of 150 m/min.

The obtained monofilaments were transparent, but as shown in Table 1, high knot strengths were not obtained.

TABLE 1

| Comparative Example | Synthetic Draw Ratio | Denier (denier) | Dry Tensile Strength (g./denier) | Dry Tensile Elongation (%) | Wet Knot Strength (g./denier) | Wet Knot Variation Ratio (%) | Wet Knot Elongation (%) | Index of Birefringence | Degree of Orientation of Amorphous Molecule $\overline{F}$ |
|---|---|---|---|---|---|---|---|---|---|
| 1 | 5.2 | 1905 | 6.5 | 32.5 | 4.2 | 8.6 | 29.3 | $50.8\times10^{-3}$ | 0.75 |
| 2 | 5.4 | 1910 | 6.9 | 30.1 | 3.8 | 12.5 | 24.3 | $52.2\times10^{-3}$ | 0.82 |
| 3 | 5.6 | 1900 | 7.2 | 25.5 | 3.5 | 22.5 | 20.9 | $53.9\times10^{-3}$ | 0.83 |

COMPARATIVE EXAMPLES 4–6

The monofilament from first-stage drawing as in Example 1 was continuously drawn at different draw ratios in hot water at 95° C. The synthetic draw ratios employed were 4.8, 5.0, and 5.2. When the monofilament was drawn at a draw ratio of 5.2, the monofilament broke often. After drawing, the monofilaments were continuously treated at a draw ratio of 0.95, in relaxed states in a hot water bath at 95° C., finishing oil was fed and the monofilaments were wound up.

The three different monofilaments were all transparent, however their knot strengths were inferior as shown in Table 2.

TABLE 2

| Comparative Example | Synthetic Draw Ratio | Denier (denier) | Dry Tensile Strength (g./denier) | Dry Tensile Elongation (%) | Wet Knot Strength (g./denier) | Wet Knot Variation Ratio (%) | Wet Knot Elongation (%) | Index of Birefringence | Degree of Orientation of Amorphous Molecule $\bar{F}$ |
|---|---|---|---|---|---|---|---|---|---|
| 4 | 4.8 | 1895 | 6.0 | 33.0 | 4.8 | 8.0 | 32.0 | $50.8 \times 10^{-3}$ | 0.72 |
| 5 | 5.0 | 1905 | 6.4 | 29.2 | 4.3 | 11.2 | 27.5 | $51.3 \times 10^{-3}$ | 0.82 |
| 6 | 5.2 | 1905 | 6.7 | 28.0 | 3.9 | 18.2 | 23.1 | $52.8 \times 10^{-3}$ | 0.85 |

EXAMPLES 2–13 AND COMPARATIVE EXAMPLES 7–16

A nylon 6/66 (95/5 in weight ratio) copolymer chip having a sulfuric acid relative viscosity of 3.4 was mixed with 0.2% by weight of N,N'-bis-stearyl-adipamide and the resulting mixture was melt spun at 275° C. from an extruder-type spinning machine. As a cooling bath, water at 5° C. was used. The resulting monofilament was subjected to first-stage drawing in a hot water bath (first step), was thereafter heat-treated in a relaxed state in high-temperature saturated steam (second step), and was thereafter heat drawn in a hot air-circulating type heating furnace at an atmosphere temperature of 400° C. (third step). It was further heatset at a draw ratio of 0.95 in a hot water bath at 95° C. (fourth step), finishing oil was fed and then the monofilaments were wound up. The winding speed was 150 m/min. and melt spinning was carried out while varying the discharged amount so as to make the denier of the final monofilament about 880 denier.

Spinning was carried out while varying the drawing conditions in the first step, the wet heat-treating conditions in the second step and the drawing conditions in the third step, respectively, and the characteristics of the resulting monofilaments were compared. The spinning conditions are shown in Table 3 and the characteristics of the corresponding monofilaments are shown in Table 4.

In Comparative Example 11, tests were carried out while varying the lengths of the steam-treating cylinder and the heating furnace. In Comparative Example 12, tests were carried out while varying the amount of the melted polymer discharged and the spinning speed.

TABLE 3

| | First Step Temperature (°C.) | First Step Draw Ratio | Second Step Steam Pressure (kg/cm² G) | Second Step Draw Ratio | Second Step Time (sec) | Third Step Temperature (°C.) | Third Step Draw Ratio | Third Step Time (sec) | Synthetic Draw Ratio |
|---|---|---|---|---|---|---|---|---|---|
| Comparative Example 7 | 92 | 2.8 | 2.4 | 0.84 | 0.84 | 400 | 2.29 | 1.41 | 5.4 |
| Example 2 | 92 | 3.5 | 2.4 | 0.84 | 0.67 | 400 | 1.84 | 1.55 | 5.4 |
| Example 3 | 92 | 4.5 | 2.4 | 0.84 | 0.52 | 400 | 1.50 | 1.44 | 5.4 |
| Comparative Example 8 | 92 | 5.2 | — | broke | — | — | — | — | — |
| Example 4 | 92 | 4.0 | 2.4 | 0.80 | 0.60 | 400 | 1.69 | 1.51 | 5.4 |
| Example 5 | 92 | 4.0 | 2.4 | 0.84 | 0.59 | 400 | 1.61 | 1.48 | 5.4 |
| Example 6 | 92 | 4.0 | 2.4 | 0.95 | 0.55 | 400 | 1.42 | 1.41 | 5.4 |
| Comparative Example 9 | 92 | 4.0 | 2.4 | 1.05 | 0.53 | 400 | 1.28 | 1.34 | 5.4 |
| Comparative Example 10 | 92 | 4.0 | 0.8 | 0.84 | 0.59 | 400 | 1.61 | 1.48 | 5.4 |
| Example 7 | 92 | 4.0 | 2.0 | 0.84 | 0.59 | 400 | 1.61 | 1.48 | 5.4 |
| Example 8 | 92 | 4.0 | 3.0 | 0.84 | 0.59 | 400 | 1.61 | 1.48 | 5.4 |
| Example 9 | 92 | 4.0 | 2.4 | 0.84 | 0.59 | 400 | 1.61 | 1.48 | 5.4 |
| Comparative Example 11 | 92 | 4.0 | 2.4 | 0.92 | 0.03 | 400 | 1.47 | 0.08 | 5.4 |
| Comparative Example 12 | 92 | 4.0 | 2.4 | 0.98 | 6.0 | 400 | 1.38 | 1.51 | 5.4 |
| Comparative Example 13 | 92 | 4.0 | 2.4 | 0.84 | 0.86 | 150 | 1.61 | 1.48 | 5.4 |
| Example 10 | 92 | 4.0 | 2.4 | 0.84 | 0.86 | 300 | 1.61 | 1.48 | 5.4 |
| Example 11 | 92 | 4.0 | 2.4 | 0.84 | 0.86 | 450 | 1.61 | 1.48 | 5.4 |
| Comparative Example 14 | 92 | 4.0 | 2.4 | 0.84 | 0.86 | 400 | 1.05 | 1.02 | 3.5 |
| Example 12 | 92 | 4.0 | 2.4 | 0.84 | 0.86 | 400 | 1.25 | 1.11 | 4.2 |
| Example 23 | 92 | 4.0 | 2.4 | 0.84 | 0.86 | 400 | 1.70 | 1.51 | 5.7 |
| Comparative Example 15 | 92 | 4.0 | 2.4 | 0.84 | 0.86 | — | — | — | 3.4 |
| Comparative Example 16 | 92 | 4.0 | — | — | — | 400 | 1.35 | 1.37 | 5.4 |

TABLE 4

| | Denier (denier) | Dry Tensile Strength (g./denier) | Dry Tensile Elongation (%) | Wet Knot Strength (g./denier) | Wet Knot Variation Ratio of Strength (%) | Wet Knot Elongation (%) | Index of Birefringence | Degree of Orientation of Amorphous Molecule $\bar{F}$ | Remarks |
|---|---|---|---|---|---|---|---|---|---|
| Comparative Example 7 | 890 | 6.0 | 42.2 | 4.8 | 8.2 | 38.2 | $48.9 \times 10^{-3}$ | 0.40 | Devitrified |
| Example 2 | 900 | 7.4 | 33.2 | 5.8 | 6.1 | 35.5 | $54.3 \times 10^{-3}$ | 0.30 | |
| Example 3 | 882 | 7.5 | 30.8 | 6.0 | 5.8 | 34.2 | $54.8 \times 10^{-3}$ | 0.22 | |
| Comparative Example 8 | 892 | — | — | — | — | — | — | — | Broke |
| Example 4 | 890 | 7.5 | 30.9 | 6.3 | 3.2 | 34.2 | $54.3 \times 10^{-3}$ | 0.23 | |
| Example 5 | 880 | 7.6 | 31.3 | 6.5 | 2.8 | 34.8 | $55.2 \times 10^{-3}$ | 0.22 | |
| Example 6 | 882 | 7.5 | 29.2 | 5.7 | 5.9 | 30.2 | $53.9 \times 10^{-3}$ | 0.32 | |
| Comparative Example 9 | 886 | 7.2 | 28.3 | 4.7 | 12.9 | 27.5 | $53.3 \times 10^{-3}$ | 0.56 | |
| Comparative Example 10 | 891 | 6.9 | 27.5 | 4.3 | 18.2 | 24.5 | $53.3 \times 10^{-3}$ | 0.76 | |
| Example 7 | 880 | 7.4 | 29.3 | 5.5 | 9.2 | 28.9 | $53.4 \times 10^{-3}$ | 0.36 | |
| Example 8 | 875 | 7.3 | 30.2 | 5.8 | 10.3 | 29.9 | $54.8 \times 10^{-3}$ | 0.24 | |
| Example 9 | 872 | 7.4 | 29.8 | 5.6 | 9.2 | 28.3 | $54.2 \times 10^{-3}$ | 0.26 | |
| Comparative Example 11 | 880 | 7.6 | 28.8 | 4.8 | 10.3 | 27.6 | $55.0 \times 10^{-3}$ | 0.58 | |
| Comparative Example 12 | 879 | 7.5 | 27.9 | 4.3 | 12.5 | 24.2 | $55.3 \times 10^{-3}$ | 0.64 | |
| Comparative Example 13 | 890 | 6.7 | 25.3 | 4.2 | 14.9 | 22.7 | $54.3 \times 10^{-3}$ | 0.69 | Devitrified |
| Example 10 | 892 | 6.9 | 26.3 | 5.5 | 10.2 | 28.2 | $53.9 \times 10^{31\ 3}$ | 0.38 | |
| Example 11 | 880 | 7.4 | 29.8 | 5.9 | 3.2 | 30.2 | $54.3 \times 10^{-3}$ | 0.36 | |
| Comparative Example 14 | 872 | 5.0 | 58.2 | 4.9 | 4.3 | 60.2 | $46.2 \times 10^{-3}$ | 0.78 | |
| Example 12 | 878 | 5.8 | 42.5 | 5.6 | 5.2 | 46.3 | $50.5 \times 10^{-3}$ | 0.30 | |
| Example 13 | 883 | 7.0 | 32.8 | 5.9 | 4.8 | 38.2 | $54.9 \times 10^{-3}$ | 0.26 | |
| Comparative Example 15 | 890 | 5.4 | 68.2 | 4.8 | 3.3 | 72.3 | $45.8 \times 10^{-3}$ | 0.10 | |
| Comparative Example 16 | 886 | 7.7 | 25.8 | 4.0 | 15.9 | 21.8 | $53.0 \times 10^{-3}$ | 0.81 | |

EXAMPLE 14 AND COMPARATIVE EXAMPLES 17–18

The monofilaments of Example 1 (product of the present invention), Comparative Example 2 and Comparative Example 5 were all knitted into net with double-knits. These knitted nets were drawn by 3% in the longitidinal direction at room temperature to fix the knots and were drawn by 7% in the lateral direction in steam at 100° C. and held for three minutes. Further, these nets were heatset under fixed conditions in lateral directions at 115° C. for three minutes. These knitted nets were immersed in a 1.5% aqueous solution of "Nylofix S 50-20 H" resin manufactured by Ota Kaken Co., Ltd. of Japan for five minutes. Thereafter the water was drained off and the nets were air dried and heatset in hot air at 80° C. for one hour to fix the knots.

Each of these knitted nets was cut apart per stitch (mesh) and measured with respect to wet-time hook strength described in JIS L 1043-1978 to obtain the results shown in Table 5. From the knitted nets using monofilaments having high knot strength according to the present invention, high-hook strength knitted nets were obtained.

TABLE 5

| | Monofilament | Denier (denier) | Strength (kg) | Tenacity (g./denier) | Elongation (%) |
|---|---|---|---|---|---|
| Example 14 | Example 1 | 1910 | 15.31 | 8.02 | 32.3 |
| Comparative | Comparative | 1910 | 12.52 | 6.55 | 29.0 |

TABLE 5-continued

| | Monofilament | Denier (denier) | Strength (kg) | Tenacity (g./denier) | Elongation (%) |
|---|---|---|---|---|---|
| Example 17 | Example 2 | | | | |
| Comparative Example 18 | Comparative Example 5 | 1905 | 13.00 | 6.82 | 28.2 |

Although this invention has been described with reference to specific examples and descriptions, it will be apparent that equivalent materials, steps, and processing conditions may be used without departing from the spirit and scope of the invention as defined in the appended claims.

What is claimed is:

1. In a process for producing a polyamide monofilament having high knot strength, the steps which comprise:

(A) drawing melt spun undrawn polyamide monofilament ($M_1$) at a ratio of about 3–5.5 to produce a partially oriented monofilament ($M_2$) having a diameter of about 0.05–2 mm;

(B) subjecting said monofilament ($M_2$) to saturated steam having a pressure not less than about 1 kg/cm$^2$.G for about 0.05–5 seconds while relaxing to produce a monofilament ($M_3$) relaxed to about 0.7–1.0 times the length of said partially oriented monofilament ($M_2$); and (C) heating said monofilament ($M_3$) in the presence of (a) a gas at about 200°-800° C. and
(b) a liquid at about 150°-265° C., said gas and said liquid being inert to said monofilament ($M_3$) for about 0.05-5 seconds and drawing said relaxed monofilament ($M_3$) at a ratio of about 1.2-2.5 to produce a drawn monofilament ($M_4$).

2. In a process for producing a polyamide monofilament having high knot strength, the steps which comprise:
(A) drawing melt spun undrawn polyamide monofilament ($M_1$) at a ratio of about 3-5.5 to produce a partially oriented monofilament ($M_2$) having a diameter of about 0.05-2 mm;
(b) subjecting said monofilament ($M_2$) to saturated steam having a pressure not less than about 1 kg/cm$^2$·G for about 0.05-5 seconds while relaxing to produce a monofilament ($M_3$) relaxed to about 0.7-1.0 times the length of said partially oriented monofilament ($M_2$); and
(C) heating said monofilament ($M_3$) in the presence of a gas at about 200°-800° C.,
said gas being inert to said monofilament ($M_3$) for about 0.05-5 seconds and drawing said relaxed monofilament ($M_3$) at a ratio of about 1.2-2.5 to produce a drawn monofilament ($M_4$).

3. In a process for producing a polyamide monofilament having high knot strength, the steps which comprise:
(A) drawing melt spun undrawn polyamide monofilament ($M_1$) at a ratio of about 3-5.5 to produce a partialy oriented monofilament ($M_2$) having a diameter of about 0.05-2 mm:
(B) subjecting said monofilament ($M_2$) to saturated steam having a pressure not less than about 1 kg/cm$^2$·G for about 0.05-5 seconds while relaxing to produce a monofilament ($M_3$) relaxed to about 0.7-1.0 times the length of said partially oriented monofilament ($M_2$); and
(C) heating said monofilament ($M_3$) in the presence of a liquid at about 150°-265° C., said liquid being inert to said monofilament ($M_3$) for about 0.05-5 seconds and drawing said relaxed monofilament ($M_3$) at a ratio of about 1.2-2.5 to produce a drawn monofilament ($M_4$).

4. A process according to claim 1, 2 or 3 wherein said inert gas is air.

5. In a process for producing a polyamide monofilament having high knot strength, the steps which comprise:
(A) drawing melt spun undrawn polyamide monofilament ($M_1$) at a ratio of about 3-5.5 to produce a partially oriented monofilament ($M_2$) having a diameter of about 0.05-2 mm;
(B) passing said monofilament ($M_2$) through a pressure chamber filled with saturated steam having a pressure not less than about 1 kg/cm$^3$·G for about 0.05-5 seconds while relaxing to produce a monofilament ($M_3$) relaxed to about 0.7-1.0 times the length of said partially oriented monofilament ($M_2$); and
(C) heating said monofilament ($M_3$) in the presence of a gas at about 200°-800° C. for about 0.05-5 seconds simultaneously with drawing said relaxed monofilament ($M_3$) at a ratio of about 1.2-2.5 to produce a drawn monofilament ($M_4$), said gas being inert to said monofilament ($M_3$).

6. A process according to claim 1, 2, 3 or 5, wherein said polyamide is a polycapramide homopolymer.

7. A process according to claim 1, 2, 3 or 5, wherein said polyamide is copolyamide and wherein at least 85% of the total weight thereof is occupied by a polycapramide component.

8. A process according to claim 1, 2, 3 or 5, wherein said polyamide is blended polyamide, and wherein at least about 85% of the total weight thereof comprises polycapramide.

9. A process for producing polyamide monofilament having a cross-sectional structure comprising a two-layer structure consisting of a core and a skin layer, an average index of birefringence of at least about $50\times10^{-3}$ and a degree of molecular orientation in the amorphous region of said skin layer of not more than about 0.5, which process comprises the steps of:
(A) drawing melt spun undrawn polyamide monofilament ($M_1$) at a ratio of about 3-5.5 to produce a partially oriented monofilament ($M_2$) having a diameter of about 0.05-2 mm;
(B) passing said monofilament ($M_2$) through a pressure chamber filled with saturated steam having a pressure not less than about 1 kg/cm$^2$·G for about 0.05-5 seconds to prepare a relaxed monofilament ($M_3$) relaxed to 0.7-1.0 times the length of said partially oriented monofilament ($M_2$);
(C) passing said monofilament ($M_3$) through a heating zone containing:
(a) a gas at about 200°-800° C. and
(b) a liquid at about 150°-265° C. that are inert to said monofilament ($M_3$) for about 0.05-5 seconds and drawing said relaxed monofilament ($M_3$) to about 1.2-2.5 times the length of said relaxed monofilament ($M_3$) to produce a drawn monofilament ($M_4$); and
(D) passing said drawn monofilament ($M_4$) through a hot water zone containing hot water at about 50°-97° C. for about 0.05-20 seconds and relaxing said monofilament ($M_4$) to about 0.9-1.0 times the length of said drawn monofilament ($M_4$) to produce a heatset monofilament ($M_5$).

10. A process for producing polyamide monofilament having a cross-sectional structure comprising a two-layer structure consisting of a core and a skin layer, an average index of birefringence of at least about $50\times10^{-3}$ and a degree of molecular orientation in the amorphous region of said skin layer of not more than about 0.5, which process comprises the steps of:
(A) drawing melt spun undrawn polyamide monofilament ($M_1$) at a ratio of about 3-5.5 to produce a partially oriented monofilament ($M_2$) having a diameter of about 0.05-2 mm;
(B) passing said monofilament ($M_2$) through a pressure chamber filled with saturated steam having a pressure not less than about 1 kg/cm$^2$·G for about 0.05-5 seconds to prepare a relaxed monofilament ($M_3$) relaxed to 0.7-1.0 times the length of said partially oriented monofilament ($M_2$);
(C) passing said monofilament ($M_3$) through a heating zone containing a gas at about 200°-800° C. that is inert to said monofilament to ($M_3$) for about 0.05-5 seconds and drawing said relaxed monofilament ($M_3$) to about 1.2-2.5 times the length of said relaxed monofilament ($M_3$) to produce a drawn monofilament ($M_4$); and
(D) passing said drawn monofilament ($M_4$) through a hot water zone containing hot water at about 50°-97° C. for about 0.05-20 seconds and relaxing said monofilament ($M_4$) to about 0.9-1.0 times the length of said drawn monofilament ($M_4$) to produce a heatset monofilament ($M_5$).

11. A process for producing polyamide monofilament having a cross-sectional structure comprising a two-layer structure consisting of a core and a skin layer, an average index of birefringence of at least about $50\times10^{-3}$ and a degree of molecular orientation in the amorphous region of said skin layer of not more than about 0.5, which process comprises the steps of:

(A) drawing melt spun undrawn polyamide monofilament ($M_1$) at a ratio of about 3–5.5 to produce a partially oriented monofilament ($M_2$) having a diameter of about 0.05–2 mm;

(B) passing said monofilament ($M_2$) through a pressure chamber filled with saturated steam having a pressure not less than about 1 kg/cm$^2$·G for about 0.05–5 seconds to prepare a relaxed monofilament ($M_3$) relaxed to 0.7–1.0 times the length of said partially oriented monofilament ($M_2$);

(C) passing said monofilament ($M_3$) through a heating zone containing a liquid at about 150°–265° C. that is inert to said monofilament ($M_3$) for about 0.05–5 seconds and drawing said relaxed monofilament ($M_3$) to about 1.2–2.5 times the length of said relaxed monofilament ($M_3$) to produce a drawn monofilament ($M_4$); and (D) passing said drawn monofilament ($M_4$) through a hot water zone containing hot water at about 50°–97° C. for about 0.05–20 seconds and relaxing said monofilament ($M_4$) to about 0.9–1.0 times the length of said drawn monofilament ($M_4$) to produce a heatset monofilament ($M_5$).

12. A process for producing polyamide monofilament having a cross-sectional structure comprising a two-layer structure consisting of a core and a skin layer, an average index of birefringence of at least about $50\times10^{-3}$ and a degree of molecular orientation in the amorphous region of said skin layer of not more than about 0.5, which process comprises the steps of:

(A) drawing melt spun undrawn polyamide monofilament ($M_1$) at a ratio of about 3–5.5 to produce a partially oriented monofilament ($M_2$) having a diameter of about 0.05–2 mm;

(B) passing said monofilament ($M_2$) through a pressure chamber filled with saturated steam having a pressure not less than about 1 kg/cm$^2$·G for about 0.05–5 seconds to produce a relaxed monofilament ($M_3$) relaxed to 0.7–1.0 times the length of said partially oriented monofilament ($M_2$);

(C) passing said monofilament ($M_3$) through a heating zone containing a gas at about 200°–800° C. for about 0.05–5 seconds simultaneously with drawing said relaxed monofilament ($M_3$) to about 1.2–2.5 times the length of said relaxed monofilament ($M_3$) to produce a drawn monofilament ($M_4$), said gas being inert to said monofilament ($M_3$), and (D) passing said drawn monofilament ($M_4$) through a hot water zone containing hot water at about 50°–97° C. for about 0.05–20 seconds and relaxing said monofilament ($M_4$) to about 0.9–1.0 times the length of said drawn monofilament ($M_4$) to produce a heatset monofilament ($M_5$).

13. A process according to claim 7, 10, 11 or 12 wherein said polyamide is a polycapramide homopolymer.

14. A process according to claim 7, 10, 11 or 12 wherein said polyamide is copolyamide, at least 85% of the total weight thereof is occupied by a polycapramide component.

15. A process according to claim 7, 10, 11 or 12 wherein said polyamide is blended polyamide, and wherein at least about 85% of the total weight thereof is occupied by polycapramide.

16. A process according to claim 7, 10, 11 or 12 wherein said inert gas is air.

17. A process according to claim 7, 10, 11 or 12 wherein said inert liquid is a member selected from the group consisting of glycerin, ethylene glycol, polyethylene glycol, polyorganosiloxane oil, mineral oil and vegetable oil.

* * * * *